US006802747B1

(12) United States Patent
Orange

(10) Patent No.: US 6,802,747 B1
(45) Date of Patent: Oct. 12, 2004

(54) CONNECTOR FOR A BATTERY CABLE CLAMP

(75) Inventor: Charles M. Orange, Nashville, TN (US)

(73) Assignee: Batlok, LLC, Nashville, TN (US)

( * ) Notice: Subject to any disclaimer, the term of this patent is extended or adjusted under 35 U.S.C. 154(b) by 117 days.

(21) Appl. No.: 10/237,341

(22) Filed: Sep. 9, 2002

(51) Int. Cl.[7] ..... H01R 4/50
(52) U.S. Cl. ..... 439/773; 439/772
(58) Field of Search ..... 439/754, 755, 439/769, 770, 756, 761, 767, 771, 772, 773

(56) References Cited

U.S. PATENT DOCUMENTS 1,814,156 A * 7/1931 Hedges ..... 439/773
1,941,773 A * 1/1934 Wright ..... 439/772
1,977,179 A 10/1934 Fisch ..... 439/773
3,084,306 A * 4/1963 Cribbs ..... 439/773
3,521,223 A * 7/1970 Martinez ..... 439/772
4,385,796 A * 5/1983 Eriksson ..... 439/772
4,555,159 A 11/1985 Chartrain et al. ..... 439/772
5,269,709 A * 12/1993 Eriksson ..... 439/772

FOREIGN PATENT DOCUMENTS

WO WO 97/03480 1/1997

* cited by examiner

*Primary Examiner*—Hien Vu
(74) *Attorney, Agent, or Firm*—Miller & Martin LLP

(57) ABSTRACT

The improved battery cable clamp connector provides additional leverage for breaking corrosion and separating the legs of the clamp by positioning the pull for mechanical advantage and designing a lever to orient at a greater angle to the connecting rod and thereby separate the battery cable clamp legs. Self-lubricating and non-corrosive materials are also used to advantage in the manufacture of the connector.

20 Claims, 5 Drawing Sheets

CONNECTOR FOR A BATTERY CABLE CLAMP

DESCRIPTION

The present invention relates generally to battery cable clamps and more particularly to a modification to existing battery cable clamps which facilitates the breaking of corroded connections and the removal of battery cable clamps from the battery post.

BACKGROUND ART

It will be appreciated by those skilled in the art that most automobiles, motorized vehicles and inboard boats are started via battery power and that the standardized modern battery is the 12-volt battery having metal posts for the opposing polarities of the battery to which connector cables are attached. The standard battery cable connector is a yoke-type structure. The battery cable is connected to one end of the connector and the yoke portion of the connector is fitted over the battery post and clamped down onto the battery post by tightening a nut onto a bolt passing through the two ends of the yoke.

Many standard 12-volt batteries will last for several years, especially when used sparingly, as in some recreational boats. During the course of the life of a battery, corrosion buildup may occur and may cause the battery clamp to attach by corrosion to the battery post. Corrosion also tends to build up between the bolt and the nut threaded on the bolt and used to tighten the yoke about the battery post. Corrosion may impair the proper transmission of battery power from the battery post through the battery cable clamp to the battery cable thereby diminishing the electrical power available. To remedy the diminished transmission of power, the battery cable clamp has to be removed, corrosion brushed away and the clamp reamed out so that a solid connection between the clamp and the post can be re-established. This process generally requires loosening of the nut on the bolt clamping the yoke about the post and "breaking" the corrosive seal between the clamp and the post to remove the clamp. In addition, if the battery is spent, the old battery must be removed and replaced with a new one. In these circumstances, once again, the battery cable clamp must be loosened and the seal of the corrosion broken to remove the clamp from the post. Because of the corrosion of the nut to the bolt clamping the yoke to the battery post, either the process of cleaning the battery post and battery cable clamp or replacing the battery can be time consuming and difficult.

What is needed, then, is a battery cable clamp that will overcome the problems with prior art devices.

SUMMARY OF THE INVENTION

Instead of the standard bolt which passes through the ends of the yoke and nut that is tightened to secure the clamp about the battery post, the battery cable clamp of the invention utilizes a bolt with a clamping handle. The connection between the bolt head and the attached handle includes a boss or camming structure that increases or decreases the clamping pressure of the bolt based on a small rotation of the handle. Thus, the nut on the bolt connecting the two legs of the yoke can be tightened finger tight and the handle rotated approximately half of a turn to substantially increase the clamping pressure of the bolt. When it is desired to remove the battery cable clamp, the handle can be released and a substantial decrease in the clamping pressure of the bolt results. The nut on the bolt can then be easily loosened to relieve additional pressure on the battery cable clamp. A lever with a hook end is fitted over the bolt and positioned between the two legs of the yoke of the battery cable clamp so that if the battery cable clamp remains corroded to the battery post, the handle can be swung to the opposite side of the bolt and a pull on the handle looped over the lever and the handle then used to apply pressure through the pull against the lever to create a wedging force between the two legs of the yoke in order to separate and spread the battery cable clamp and loosen it from the battery post. Preferably at least the handle, nut and seat interfacing with the boss on the handle are made of non-corrosive and even non-metallic materials. In this fashion, preferably the entire operation of the invention is possible without the need for using any additional tools.

DETAILED DESCRIPTION OF THE INVENTION

Figure 1:
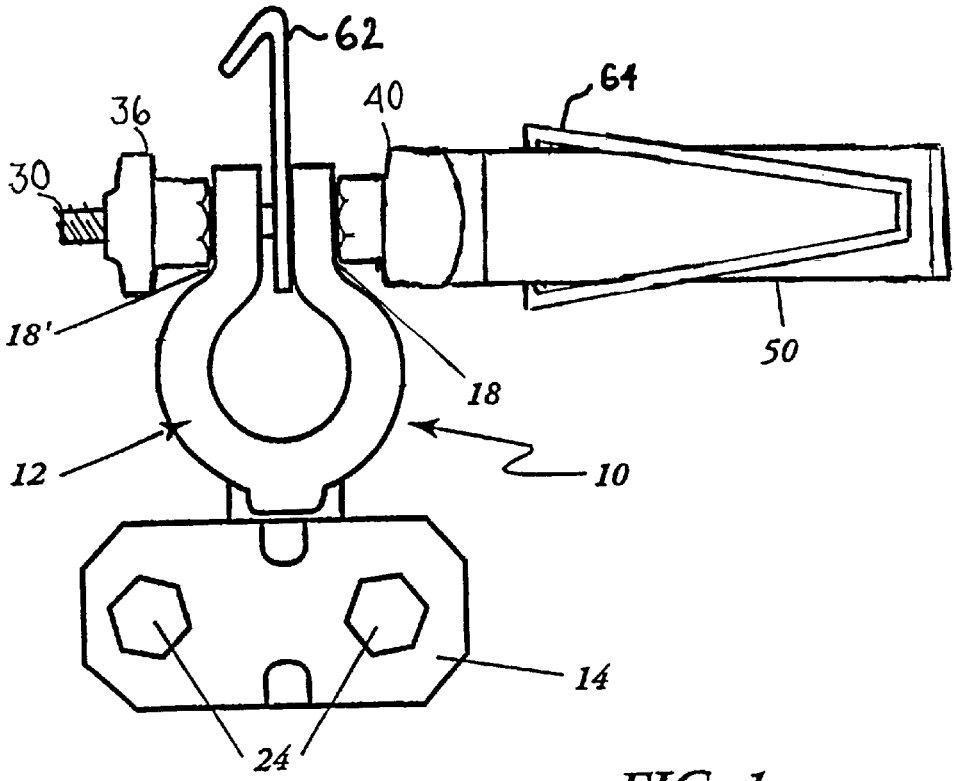
FIG. 1 is a top view of the battery cable clamp and an improved connector device of the present invention.

A description of the preferred embodiment of the present invention will be best understood by referring to FIGS. 1–10 of the accompanying drawings wherein like reference numerals refer to like parts.

Figure 2:
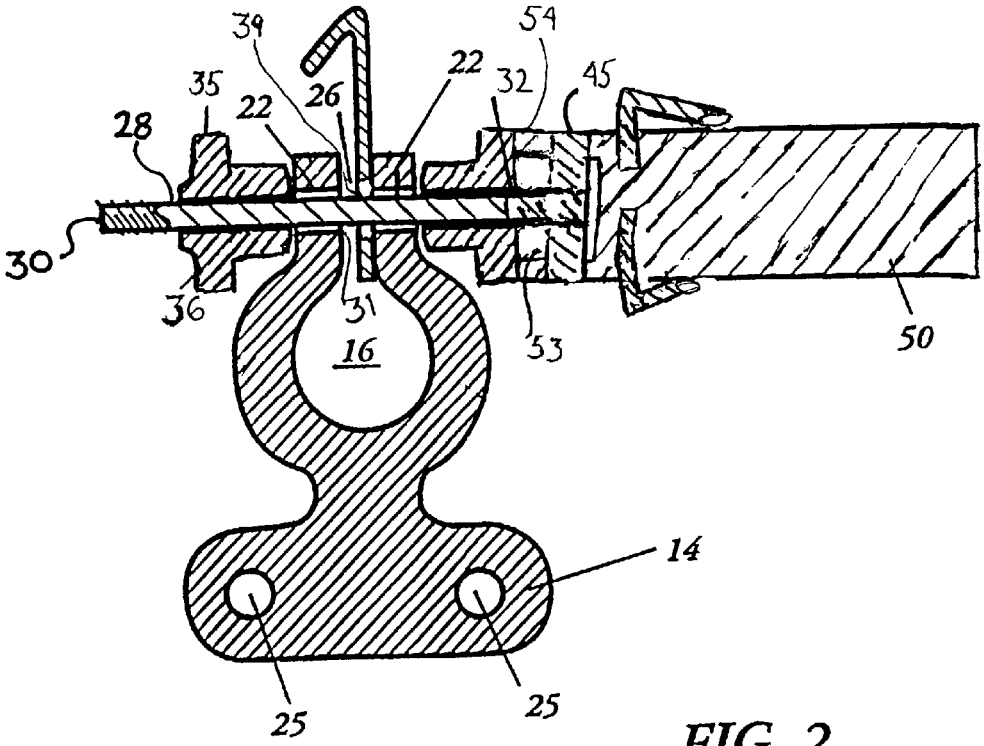
FIG. 2 is a top view in partial cross section of the battery cable clamp and connector.
Figure 3:
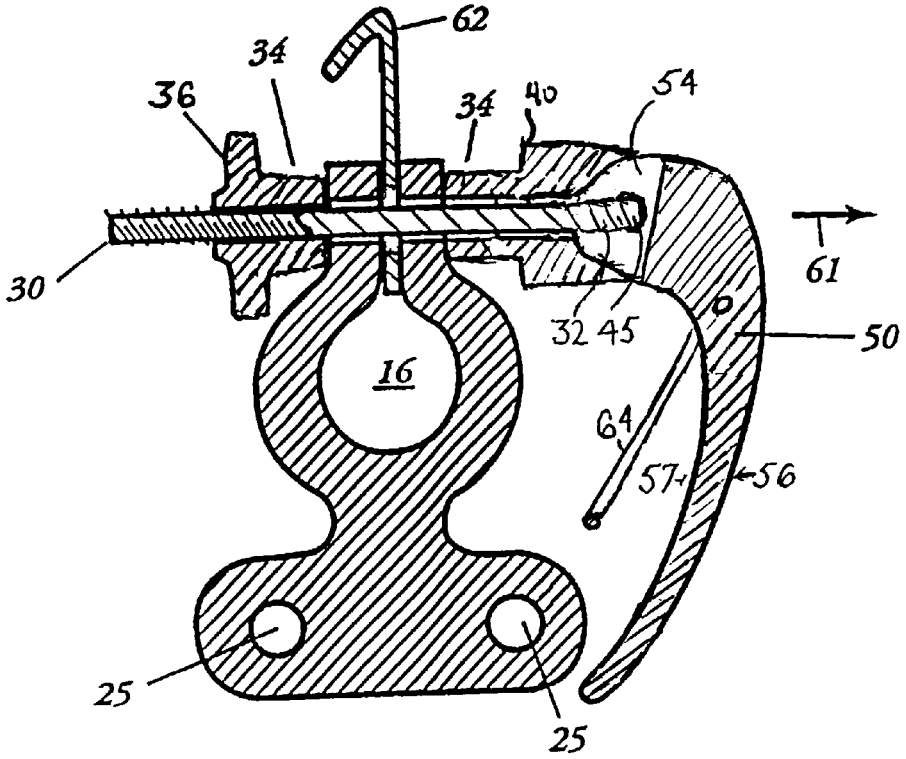
FIG. 3 is a top view in partial cross section showing the connector handle in the clamping position.

Referring first to FIGS. 1, 2 and 3, a battery clamp 10 of known and standard design and function, apart from lever 62 and pull 64, is illustrated. The battery clamp 10 includes an arcuate post section 12 and a cable section 14. The post section 12 defines a battery post cavity 16 designed to fit over and mate with the battery post of a standard vehicle battery (shown as T in FIGS. 6 and 7). Extending from the arcuate post portion 12 of the clamp 10 are legs 18, 18' which together form a clevis on the opposite side of the battery post cavity 16 from the cable section 14. The legs 18, 18' each have a hole 22 therein and the holes 22 are in registry, having a common axis. In a conventional battery clamp 10, a bolt of approximately the same size as holes 22 is threaded through the holes 22 and securely fastened with a bolt, thereby clamping legs 18, 18' and securing post section 12 against the battery post.

On the opposite end of the clamp 10, at the cable section 14, are cable connectors. The cable connectors, as can be seen from FIG. 5, can be bolts 24 passing through openings 25 in the cable section 14 of the clamp 10. The bolts 24 can be threaded and the holes 25 can be internally threaded so that the bolts can be tightened down against the battery cable (not shown) by threading bolts 24 into threaded openings 25 in the cable section 14 of the clamp 10. Alternatively, nuts and washers can be provided to retain the bolts 24 in unthreaded openings 25 of the cable section 14. The integral construction of the clamp 10, including the post section 12 and the cable section 14, allows power generated from the battery to be transferred from the battery post, to the post section 12 by virtue of the clamping action of the legs 18, 18' engaging the post section 12 against the battery post, from the post section 12 to the cable section 14 and eventually to the battery cables (not shown) which are connected to the clamp 10 by the connectors 24. Thus, the power generated by the battery is transmitted through the battery clamp 10 to the battery cable which is in turn connected to a solenoid, a starter motor or other electrical devices. All of the features just described of a standard battery cable clamp are well known in the art.

In the traditional battery cable clamp, the holes 22 in the legs 18, 18' will have a bolt passing through them and a nut screwed onto the end of the bolt. When the battery cable clamp is in place, the nut is turned to apply clamping pressure against the legs 18, 18' holding the arcuate post section 12 about the battery post. Once the battery clamp is in this tightened position, it may remain in static contact with the battery post for years.

During these long periods of time, corrosion often binds clamps to their associated battery posts, and the nut and bolt securing the legs 18,18' may also rust or corrode so that it is difficult to remove the battery clamp from the battery post. In Applicant's invention, the standard bolt and nut are replaced by a unique structure which facilitates the breaking of a corrosion seal and the spreading of the legs of the battery cable clamp so that the clamp can be easily removed, even when the object of severe corrosion.

Applicant's improved connector for the battery cable clamp is installed by removing the standard nut and bolt connection and placing it with a connecting rod 28 and cammed handle 50 assembly. The connecting rod 28 has a threaded distal end 30 and a threaded proximal end 32. Spacers may be fitted about the connecting rod when it is installed in order to properly position the handle structure for adequate leverage when operated, although the spacers are preferably integrally formed with other components of the assembly as hereinafter described.

Figure 10:
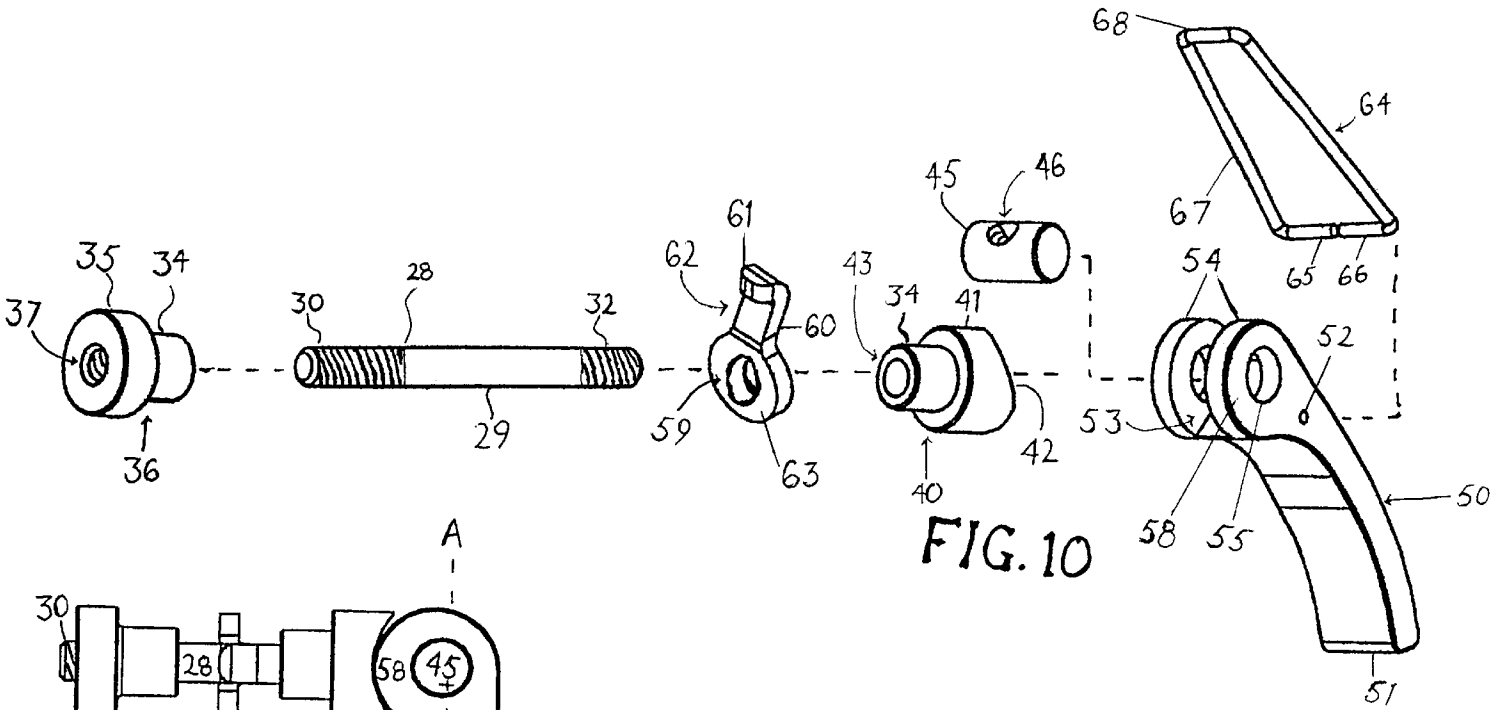
FIG. 10 is an exploded perspective of the battery cable clamp connector of the present invention.

The preferred components for applicant's connector are illustrated in an exploded view in FIG. 10. Instead of standard nut and bolt, applicant's improved connector consists of a fastener 36 which may be a nut or a wing nut, connecting rod 28 which might be a bolt, a lever 62, a seat 40, a pin 45, and a cammed handle 50 with pull 64. The pin 45 is mounted in the base of handle 50 and the proximal end 32 of connecting rod 28 secured to the pin. The seat 40 is placed on connecting rod 28 and connecting rod 28 is then inserted through opening 22 in leg 18 through opening 59 in lever 62 through opening 22 and leg 18' and then secured to fastener 36. Fastener 36 may be adjusted to place pressure on legs 18,18'. FIGS. 1 through 4 show fastener 36 having a threaded aperature 37, a grasping perimeter portion 35 and spacer portion 34. Fastener 36 is rotated over the threaded end 30 of connecting rod 28 until about finger tight.

Figure 3A:
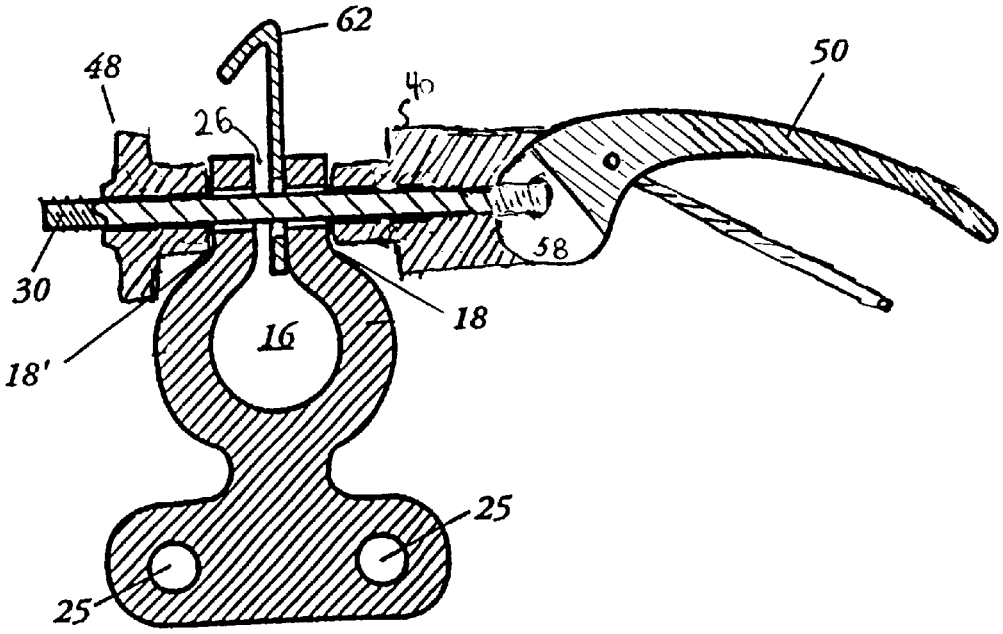
FIG. 3A is a top view in partial cross section showing the connector handle in the released position.

FIG. 3 shows the connector completely tightened on legs 18,18'. After finger tightening fastener 36 with handle 50 in the open position as shown in FIG. 3*a,* complete tightening is accomplished by rotating cammed handle 50 so that the bossed portion 58 rotates into the seat 40 as shown in FIG. 3. The camming action of the boss 58 against the cam surface 42 of seat 40 pushes seat 40 distally along bolt 28. This causes legs 18,18' to clamp upon lever 62. When the handle 50 is rotated so that the bossed portion 58 moves away from seat 40 as shown in FIG. 3*a,* pressure on legs 18,18' is relaxed and space 26 is created between the legs. This indicates that the arcuate post section 12 has been opened sufficiently to be removed from the battery terminal.

Because the principal purpose of the improved connector is to address difficulties that arise due to corrosion binding parts together, the design of the component parts include several features to resist corrosion. Specifically, fastener 36 and seat 40 are preferably injection molded from glass filled nylon. This material is corrosion-resistant like nylon, but has superior tensile strength and stiffness, even when subjected to high temperatures, but also enjoys low thermal expansion similar to metals. The spacer sections 34 (shown in FIGS. 3 and 10) could be separate spacer elements, but are advantageously integrally molded as portions of fastener 36 and seat 40. The use of glass-filled nylon to mold these parts not only prevents corrosion between fastener 36 and both leg 18' and threads 30 and also between leg 18 and seat 40, but in fact provides self-lubricating properties to help prevent binding of parts. In addition, connecting rod 28 preferably has a noticeably smaller diameter than aperatures 22, at least over the central portion 29 which passes through aperatures 22 in legs 18,18'. The aperatures 22 have a typical diameter of about 0.3125 inches, so a preferred diameter of connecting rod 28 is about 0.25 inches. This helps prevent binding of connecting rod 28 within aperatures 22. The handle 50 may also be formed from glass filled nylon to prevent its corrosion to any portion of the battery or clamp.

Figure 4:
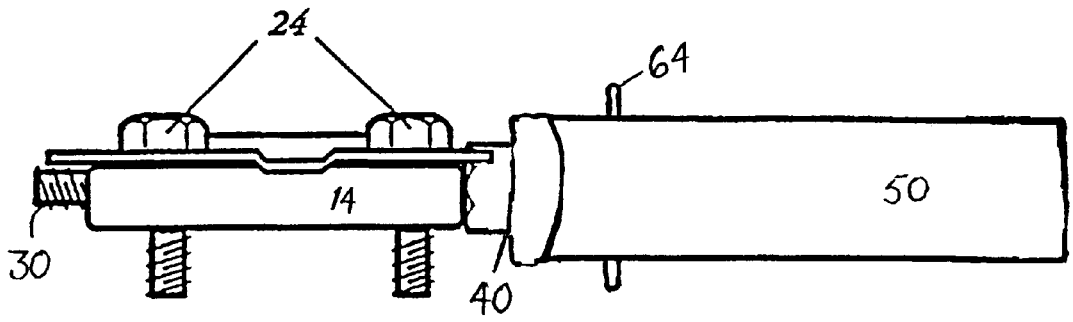
FIG. 4 is a side view of the battery cable clamp of the present invention.
Figure 5:
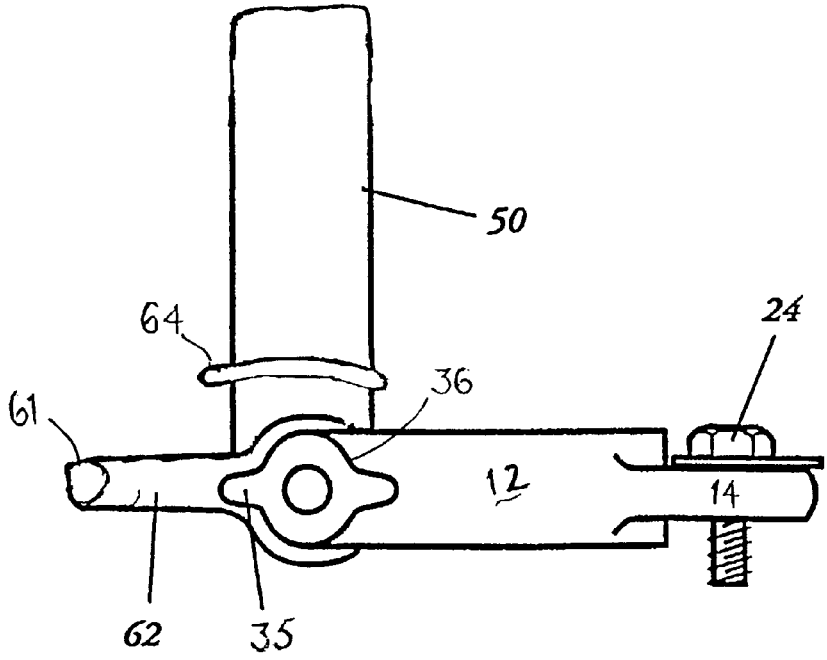
FIG. 5 is an end view of the battery cable clamp of the present invention.
Figure 6:
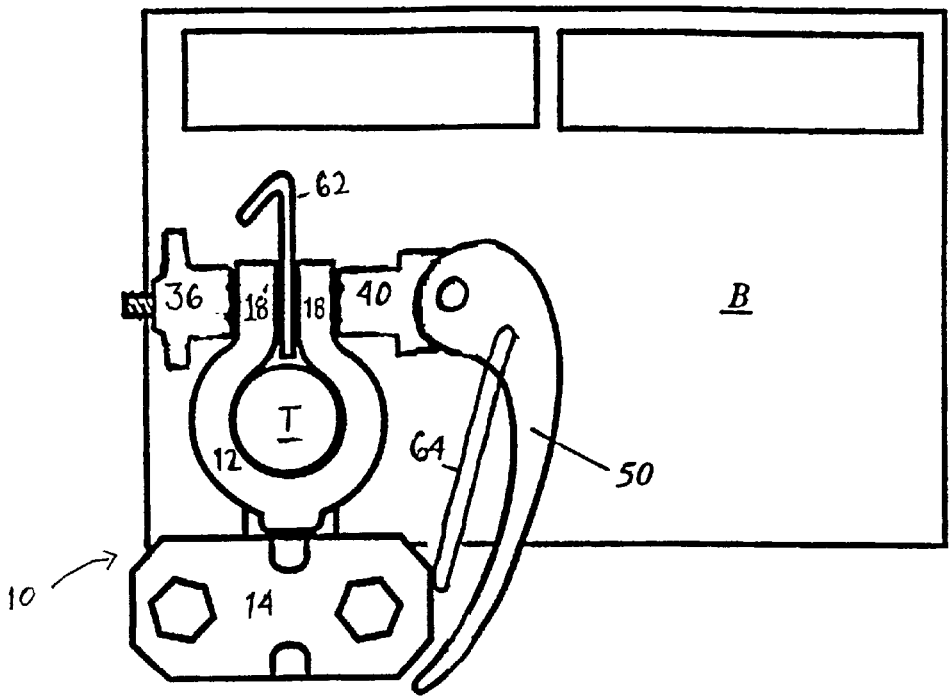
FIG. 6 is a top view of the battery cable clamp in position and in place on and part of a battery.
Figure 7:
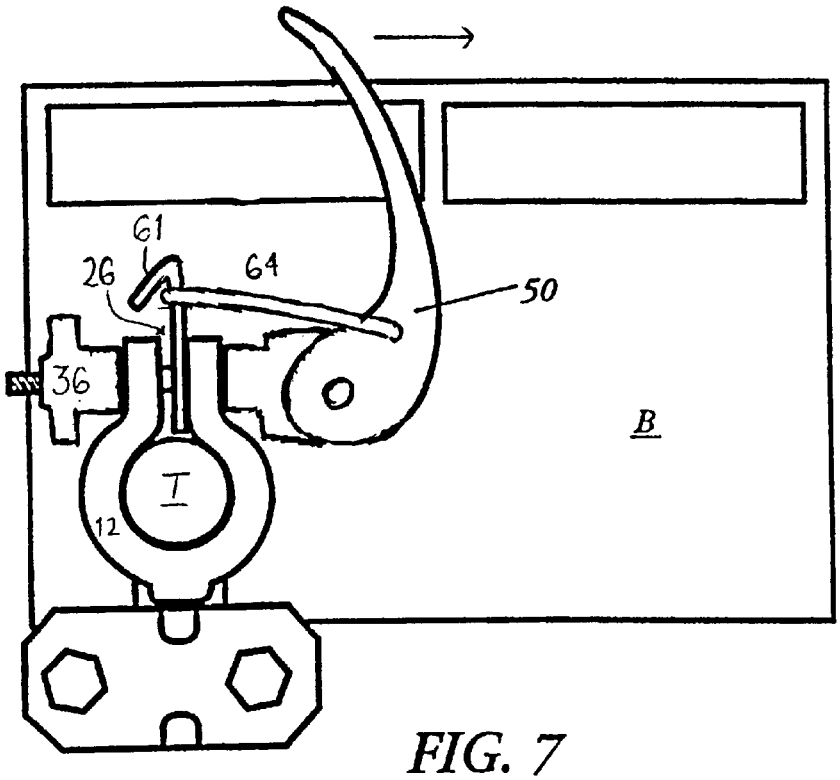
FIG. 7 is a top view of the battery cable clamp of the present invention with the handle in a position to provide pulling force on the spreading lever.

FIGS. 4 and 5 provide alternative side and end views of a connector according to the present invention. FIGS. 6 and 7 address an additional corrosion breaking feature of the improved connector. FIG. 6 shown the battery cable connector 10 clamped on one terminal T of battery B. It is understood, though omitted from the illustration, that the battery usually will have a second terminal with a second battery cable connector affixed. In FIG. 6 the improved connector is shown clamping legs 18,18' and thereby causing post section 12 to tightly engage terminal T. In some instances, even when the handle 50 is moved to an unlocking position, corrosion causes legs 18,18' to remain clamped and the post section 12 remains tightly engaged with terminal T. To address this problem, the improved connector may be rotated so that pull 64 engages lever 62 and is held in place on the lever by hook 61. After loosening fastener 36, the distal end 51 of handle 50 may be pulled in the direction of the arrow in FIG. 7 to provide mechanical advantage and pressure on pull 64. The pressure of pull 64 at the top of lever 62 tends to cause lever 62 to tilt on connecting rod 28. As explained below, this tilting action is facilitated by an oval aperature 59 in lever 62 which allows significant space 39 (shown in FIG. 2) for movement. This movement causes the base mounting section 59 of lever 62 to be angled between legs 18,18' and thereby separate the legs. In the preferred embodiment, the shape of aperature 59 permits the lever 62 to tilt or pivot to an angle of about fifteen degrees (15°) from perpendicular with the connecting rod 28. This in turn loosens the post section 12 and permits the battery cable connector to be removed from terminal T. Because fastener 36 is non-corrosive and preferably glass filled nylon, it can be loosened by hand, even in the case of severely corroded battery terminals. This permits the entire corrosive breaking operation of the clamp to be accomplished without using additional tools The post 60 of lever 62 has a width at least approximating the width of the connecting rod 28 to provide adequate strength when the lever in activated by pull 64. In addition, the distal end 68 of pull 64 is preferably squared off to fit about post 60. Both lever 62 and handle 50 are advantageously rotatable with respect to the rest of the device to facilitate the avoidance of obstructions either on the battery, or from other components in the close confines of an engine compartment.

Figure 9:
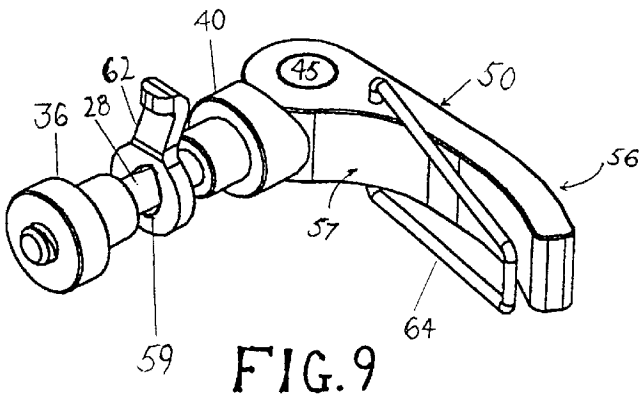
FIG. 9 is a perspective view of the battery cable clamp connector of the present invention in isolation.
Figure 8:
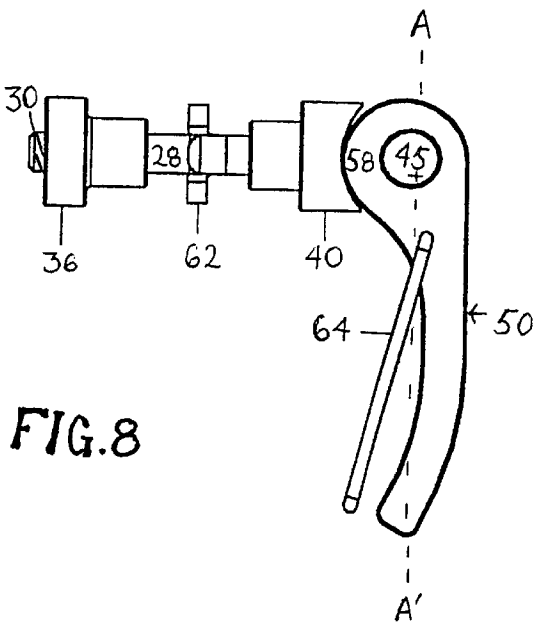
FIG. 8 is a side view of the battery cable clamp of the present invention in isolation with the connector handle rotated to the clamping position.

FIGS. 8 and 9 provide views of the improved connector in isolation, while FIG. 10 provides an exploded view of the constituent parts of the improved connector. Of particular note with regard to seat 40 is that the seat portion 41 has a concave cam surface 42 upon which wings 54 of the handle may rotate. A channel 53 is defined between wings 54 to permit the handle 50 to be rotated with respect to the post section 12 without interfering with connecting rod 28. Aperatures 55 in wings 54 accommodate pin 45. In addition, aperatures 52 on the sides of handle 50 to receive a connecting section in the form of mounting posts 65, 66 of pull 64. As shown in FIG. 9, pull 64 is preferably connected to handle 50 proximate the bossed end and distally from opposite unconnected end 51. The preferred distance from pin 45 about which handle 50 rotates, to mounting aperatures 52 for pull 64 should be between one-tenth and one-third of the distance from the edge of pin 45 to the unconnected end 51 of handle 50. When the pull 64 is moved more distally from pin 45 along handle 50, mechanical advantage is sacrificed in both the leverage provided by the extra length of the handle and by aligning the arm 67 of pull 64 substantially out of perpendicular with post 60 of lever 62. The placement of pull 64 close to pin 45 and the use of elongated opening 59 in hook 60 contribute to significant mechanical advantage over prior art corrosion-breaking connectors.

In addition, it will be seen that the preferred handle 50 has a concave side 57 and convex side 56 as shown in FIG. 9. Arms 67 of pull 64 are preferably long enough to permit the distal end 68 of pull 64 to engage with lever 62, but insufficiently long to permit pull 64 to flip from concave side 37 to convex side 56 of handle 50. This results in pull 64 always being positioned between handle 50 and connecting rod 28 on which hook 62 is mounted.

The boss 58 on wings 54 of handle 50 is preferably located substantially perpendicular to the longitudinal axis A, A' shown in FIG. 8 of handle 50 and adjacent to aperatures 55 through which pin 45 is received. In addition, the bosses 58 are preferably located on the concave side 57 of handle 50. This arrangement of boss 58, pull 64, and concave side 57 of handle 50 permits the most compact locking position for the improved connector as shown in FIG. 3. In addition, by keeping pull 64 between connecting rod 28 and handle 50, pull 64 is prevented from interfering with other components on or near the battery.

Finally, lever 62 is preferably designed with an oval aperature 59 to fit over connecting rod 28. If the aperature 59 is sized only slightly larger than connecting rod 28, then the walls of mounting section 63 bind with the connecting rod 28 and interfere with the movement of the lever 62 when it is only slightly tilted from perpendicular with the connecting rod 28. By increasing the length of aperature 59, at least in the direction of the longitudinal axis of post portion 60, the lever 62 and its mounting section 63 may be more severely angled out of perpendicular with connecting rod 28 before binding. The lever should be able to achieve an angle of at least ten degrees (10°) and preferably about fifteen degrees (15°) from perpendicular. When lever 62 can be pulled substantially out of perpendicular with connecting rod 28, the mounting section 63 of lever 62 can apply pressure to achieve greater separation of legs 18, 18' and thereby facilitate removal of the clamp 10. Preferably the aperature 59 will have a length in the direction of the longitudinal axis of post portion 60 of at least 125% of the diameter of the connecting rod 28. So that for a connecting rod 28 of diameter of 0.25 inches, the aperature 59 would have a length at least 0.3125 inches and preferably of 0.344 inches in the longitudinal direction.

While the invention has been described in terms of its preferred embodiments, numerous alterations of the products and methods herein described will suggest themselves to those skilled in the art. It will be understood that the details and arrangements of the embodiments that have been described and illustrated in order to explain the nature of the invention are not to be construed as any limitation of the invention, and all such alterations which do not depart from the spirit of invention are intended to be included within the scope of the appended claims.

I claim:

1. An improved connector for a battery cable clamp comprising:

(a) a handle having a first end with two parallel wings having aperatures therein and being separated by a channel, and a second opposite end;

(b) a pin received within the aperatures of the parallel wings, and spanning the channel between said wings;

(c) a connecting rod of diameter less than about 0.3 inches, having a proximal end connected through a hole of the pin in the channel between the wings, said rod extending through said channel away from the handle to a threaded distal end;

(d) a seat having an aperature upon which the rod is received, and a cam surface at a rear end thereon which is adjacent to the parallel wings;

(e) a lever having a mounting section with an aperature upon which the rod is received and a post section extending longitudinally outward from the mounting section, wherein the width of the aperature in the direction of the longitudinal axis of the post section is at least 125% of the diameter of the rod;

(f) a fastener having a threaded aperature being received on the threaded distal end of the rod; and (g) a pull having a first end connected to the handle, wherein the lever is positioned between the seat and the fastener.

2. The improved connector for a battery cable clamp of claim 1 wherein the first end of the pull is attached to the handle proximate to the aperatures of the parallel wings, and between said aperatures and the second opposite end of the handle.

3. The improved connector for a battery cable clamp of claim 1 wherein the pull has a pair of legs connecting the first end to an opposite distal end, such that the configuration of the legs does not permit the opposite distal end to be moved across the second opposite end of the handle.

4. The improved connector for a battery cable clamp of claim 3 wherein the handle has a concave side and a convex side, and the pull extends from the handle on the concave side.

5. The improved connector for a battery cable clamp of claim 4 wherein the handle has a longitudinal axis and a boss upon each of the parallel wings extending substantially perpendicular to the longitudinal axis on the concave side of the handle.

6. The improved connector for a battery cable clamp of claim 1 wherein at least one of the handles, the fastener and the seat is manufactured from a non-corrosive material.

7. The improved connector for a battery cable clamp of claim 6 wherein the non-corrosive material is glass filled nylon.

8. The improved connector for a battery cable clamp of claim 1 wherein at least one of the fasteners and the seat has an integrally formed spacer thereon.

9. The improved connector for a battery cable clamp of claim 1 wherein the diameter of the connecting rod is no greater than about 0.275 inches.

10. An improved battery cable clamp comprising:

(a) a cable section having cable connectors to secure a battery cable;

(b) a post section connected to the cable section, and defining a cavity to receive a battery post;

(c) a pair of legs extending from the post section, each leg having an axially aligned aperature therein;

(d) a connecting rod passing through the axially aligned aperatures in the legs, having a diameter, a proximal end and a distal end;

(e) a lever having a mounting section with an aperature receiving the connecting rod and being positioned between the pair of legs;

(f) a pin having a hole being connected through by the proximal end of the connecting rod;

(g) a seat having a cam surface and an aperature receiving the connecting rod, and being positioned between the pair of legs and the pin;

(h) a handle having a first end with a pair of parallel wings having aperatures therein which receive the pin, said wings being separated by a channel, and said handle having a second opposite end;

(i) a pull having a connecting end attached to the first end of the handle between the pin receiving aperatures and the second opposite end; and (j) a fastener connected to the distal end of the connecting rod.

11. The improved battery cable clamp of claim 10 wherein the lever has a post section extending longitudinally outward from the mounting section and the width of the aperature in the direction of the longitudinal axis of the post section is at least about one-third greater than the diameter of the connecting rod.

12. The improved battery cable clamp of claim 10 wherein the pull has a pair of legs connecting the first end to an opposite lever engaging end, such that the configuration of said pair of legs does not permit the lever engaging end to be moved across the second opposite end of the handle.

13. The improved battery cable clamp of claim 10 wherein the handle has a concave side and a convex side; and the pull extends from the handle on the concave side.

14. The improved battery cable clamp of claim 13 wherein the handle has a longitudinal axis and a boss upon each of the parallel wings extending substantially perpendicular to the longitudinal axis on the concave side of the handle.

15. The improved battery cable clamp of claim 10 wherein at least one of the handles, the fastener and the seat is manufactured from a non-corrosive material.

16. The improved battery cable clamp of claim 15 wherein the non-corrosive material is glass filled nylon.

17. The improved battery cable clamp of claim 10 wherein at least one of the fasteners and the seat has an integrally formed spacer thereon.

18. The improved battery cable clamp of claim 10 wherein the diameter of the connecting rod is no greater than about 0.275 inches.

19. A method for removing a battery post attached by corrosion to a battery cable clamp of the type having a cable section secured to a battery cable; a post section connected to the cable section and defining a cavity in which the battery post is received; a pair of legs extending from the post section in a direction generally opposite to the cable section and each leg having an axially aligned aperature therein with a connecting rod passing through said aperatures; said connecting rod having a proximal end and a distal end; a lever having a mounting section with an aperature receiving the connecting rod and a post section extending longitudinally from the mounting section and being substantially perpendicular to the connecting rod and positioned between the pair of legs; a pin attached to the proximal end of the connecting rod; a seat having a cam surface and an aperature receiving the connecting rod and being positioned between the pair of legs and the lever; a handle having a concave side and a convex side, and a first camming end with a pair of parallel wings having aperatures therein receiving said pin and said pair of wings having separated by a channel through which the connecting rod passes through to reach the pin, and said handle having an opposite second end; a pull having a connecting end attached to the camming end of the handle; and a fastener connected to the distal end of the connecting rod; comprising the steps of:

(a) loosening the fastener or the distal end of the connecting rod;

(b) rotating the handle to align the pull with the post section of the lever;

(c) placing the pull over the post section of the lever;

(d) applying pressure to the concave side of the handle near the opposite second end of the handle to transmit force through the pull to the lever;

(e) causing the lever to move in the direction of the longitudinal extension of a post section end to pivot from a position perpendicular to the axis of the connecting rod, thereby causing the mounting section of the lever to space apart the legs of the post section of the clamp; and (f) removing the post section of the clamp from the battery post.

20. The method of claim 19 wherein the lever moves in the direction of the longitudinal extension of the post section pivots at least about ten degrees (10°) from the perpendicular.

* * * * *